US007492324B2

(12) United States Patent
Stroes et al.

(10) Patent No.: US 7,492,324 B2
(45) Date of Patent: Feb. 17, 2009

(54) METHOD AND APPARATUS FOR RECEIVING DUAL BAND SIGNALS FROM AN ORBITAL LOCATION USING AN OUTDOOR UNIT WITH A CONCENTRIC ANTENNA FEED

(75) Inventors: Gustave Stroes, Beverly Hills, CA (US); Patrick J. Loner, Los Angeles, CA (US)

(73) Assignee: The DIRECTV Group, Inc., El Segundo, CA (US)

( * ) Notice: Subject to any disclaimer, the term of this patent is extended or adjusted under 35 U.S.C. 154(b) by 144 days.

(21) Appl. No.: 11/602,822

(22) Filed: Nov. 21, 2006

(65) Prior Publication Data

US 2008/0117116 A1 May 22, 2008

(51) Int. Cl.
*H01Q 13/00* (2006.01)

(52) U.S. Cl. ..... 343/781 R; 343/756; 343/DIG. 2

(58) Field of Classification Search ..... 343/781 R, 343/909, DIG. 2, 755, 756, 840
See application file for complete search history.

(56) References Cited

U.S. PATENT DOCUMENTS

| | | | | |
|---|---|---|---|---|
| 6,504,514 | B1 * | 1/2003 | Toland et al. | 343/781 P |
| 6,577,283 | B2 * | 6/2003 | Wu et al. | 343/786 |
| 6,747,608 | B2 * | 6/2004 | Wu | 343/909 |
| 6,947,702 | B2 | 9/2005 | Green, Sr. | 455/3.02 |

* cited by examiner

*Primary Examiner*—Tho G Phan

(57) ABSTRACT

A satellite system 10 having a first satellite 14 at a first orbital slot B has a first transponder 32 and a second generating a first downlink signal 44B at a first frequency and a second downlink signal 44C at a second frequency. An outdoor unit is directed toward the first satellite 14 and includes a support structure, a reflector 64 coupled to the support structure and reflecting the first downlink signal and the second downlink signal. A first feed 66B is coupled to the support structure and receives the first downlink signal. A second feed 70C is concentric with the first feed 66B and is coupled to the support structure and receives the second downlink signal.

30 Claims, 4 Drawing Sheets

METHOD AND APPARATUS FOR RECEIVING DUAL BAND SIGNALS FROM AN ORBITAL LOCATION USING AN OUTDOOR UNIT WITH A CONCENTRIC ANTENNA FEED

FIELD

The present disclosure relates generally to a satellite signal receiving outdoor unit, and more particularly, to an outdoor unit having multiple feeds for receiving various frequency bands.

BACKGROUND

The statements in this section merely provide background information related to the present disclosure and may not constitute prior art.

Satellite data and television systems use an outdoor unit that includes a reflector that directs satellite signals to a feed. The reflector is typically aligned at a particular satellite so that the signals from the satellite are concentrated at the feed. This allows the feed to receive a strong signal. Satellites typically generate one frequency and the feed is tuned for that particular frequency.

Some satellite systems include satellites that are capable of transmitting more than one frequency. That is, a satellite may be provided with more than one transponder that is capable of generating signals at another frequency than another transponder on the same satellite. The second frequency signals are thus not utilized.

Satellite television providers try to increase the amount of services they provide. Additional satellites are expensive and, thus, maximizing the amount of services from existing satellites is an important goal.

Therefore, it is desirable to utilize signals at a different frequency than a primary frequency in a satellite system.

SUMMARY

In one aspect of the disclosure, a system includes a first satellite at a first orbital slot having a first transponder generating a first downlink signal at a first frequency and a second downlink signal at a second frequency. The system also includes an outdoor unit directed at the first satellite that includes a support structure, a reflector coupled to the support structure and reflecting the first downlink signal and the second downlink signal, a first feed coupled to the support structure receiving the first downlink signal and a second feed concentric with the first feed and coupled to the support structure receiving the second downlink signal.

In a further aspect of the disclosure, an outdoor unit includes a support structure, a reflector coupled to the support structure reflecting a first downlink signal from a first satellite and a second downlink signal from a second satellite and a first feed coupled to the support structure receiving the first downlink signal. A second feed is concentric with and coupled to the support structure and receives the second downlink signal.

One advantage of the disclosure is that the system may be implemented in a bolt-on configuration. That is, existing outdoor units having a feed support structure and primary reflector may be retrofitted with a concentric feed to receive signals in both frequencies. The system may also be implemented in a factory-ready implementation already including the concentric feed.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
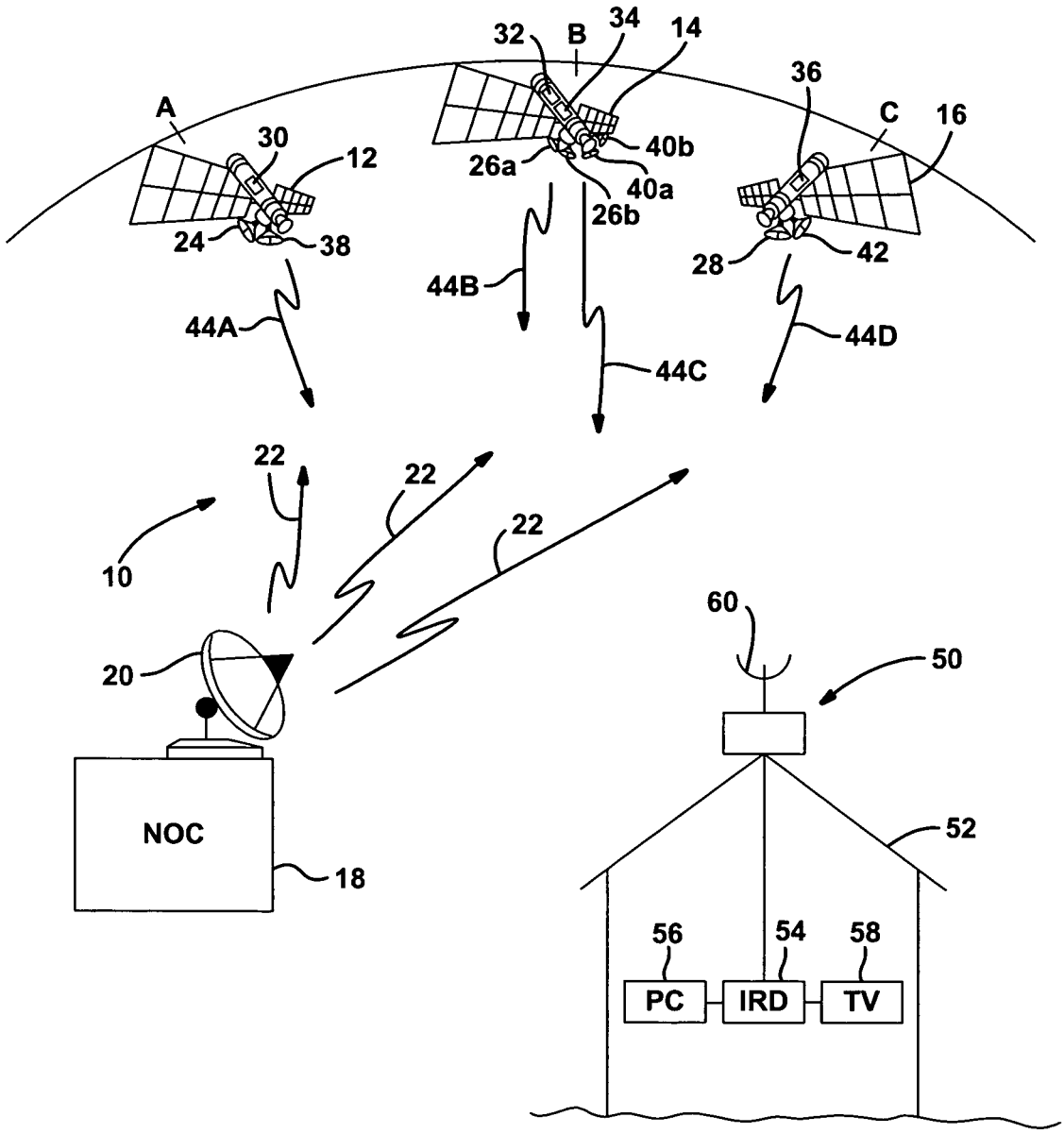
FIG. 1 is a system view of a satellite transmission system formed according to the present disclosure.

The following description is merely exemplary in nature and is not intended to limit the present disclosure, application, or uses. It should be understood that throughout the drawings, corresponding reference numerals indicate like or corresponding parts and features. The present disclosure is described with respect to a satellite television system. However, the present disclosure may be used for various uses including satellite transmission and data transmission and reception for home or business uses.

Referring now to FIG. 1, a satellite system 10 according to the present disclosure includes satellites 12, 14 and 16 that receive uplink signals from a network operation center 18. The network operation center includes a transmitting antenna 20 that may be implemented as a plurality of transmitting antennas. The transmitting antenna 20 transmits uplink signals 22 to respective receiving antennas 24, 26 and 28 on satellites 12, 14 and 16. Satellite 14 may also include two satellite antennas 26A and 26B, although one receiving antenna may be provided. Satellite 12 includes a transponder 30. Satellite 14 includes two transponders 30 and 34. Satellite 16 includes a transponder 36. Satellite 12 may also include a transmitting antenna 38. Satellite 14 may include one or two transmitting antennas 40A and 40B. Satellite 16 includes a transmitting antenna 42. The transmitting antennas 38, 40A, 40B and 42 generate downlink signals 44A, 44B, 44C and 44D. As will be further described below, transponders 32 and 34 may generate downlink signals 44B and 44C having different downlink frequencies. For example, downlink signal 44B may be at the Ku band. Downlink signals 44A, 44C and 44D may be at the Ka band. It should be noted two collocated satellites transmitting different frequencies may replace satellite 14.

The satellites 12, 14 and 16 may be positioned at various orbital spots A, B and C. In one configuration, orbital spots A, B and C comprise orbital spots 99° West, 101° West and 103° West, respectively. The orbital spacings are consecutive geosynchronous orbital spacings. However, the orbital spacings need not be consecutive. It should be noted that the government requires a two degree spacing between orbital slots for Ka band in the geosynchronous plane. Spacing for Ku band is nine degrees. The present satellites 12, 14 and 16 are geosynchronous satellites.

An outdoor unit 50 coupled to a building 52 such as a home, multi-dwelling unit or business, receives the satellite downlink signals 44 and provides the signals to a processing circuit such as an integrated receiver decoder 54. Data signals may be used by the computer 56 and television signals may be used by the television 58. The outdoor unit 50 includes a receiving antenna structure 60.

Figure 2:
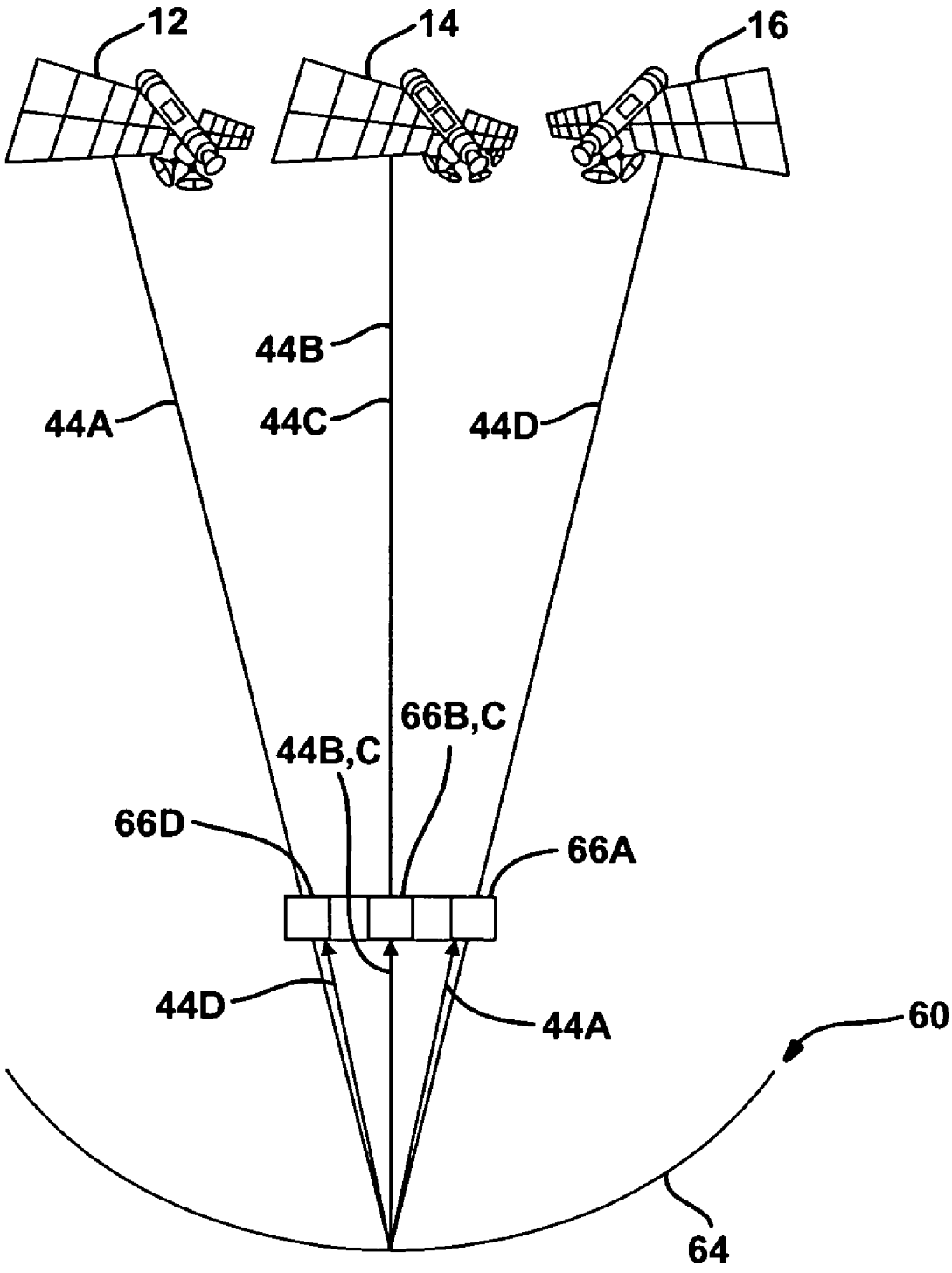
FIG. 2 is a diagrammatic view of the system and the associated axis.

Referring now to FIG. 2, a simplified diagram of a top view of the downlink signals 44A, 44B and 44C relative to the satellites 12, 14 and 16 and the receiving antenna structure 60. The primary axis of the reflector 64 is along the downlink direction 44B so that downlink signals 44B and 44C reflect from the antenna structure and are reflected to feed 66B and 66C, respectively. Downlink signals 44A reflect to feed 66A and downlink 64D reflect to feed 66D. As is illustrated, the feeds are slightly spaced apart and receive the particular satellite signal.

Figure 3:
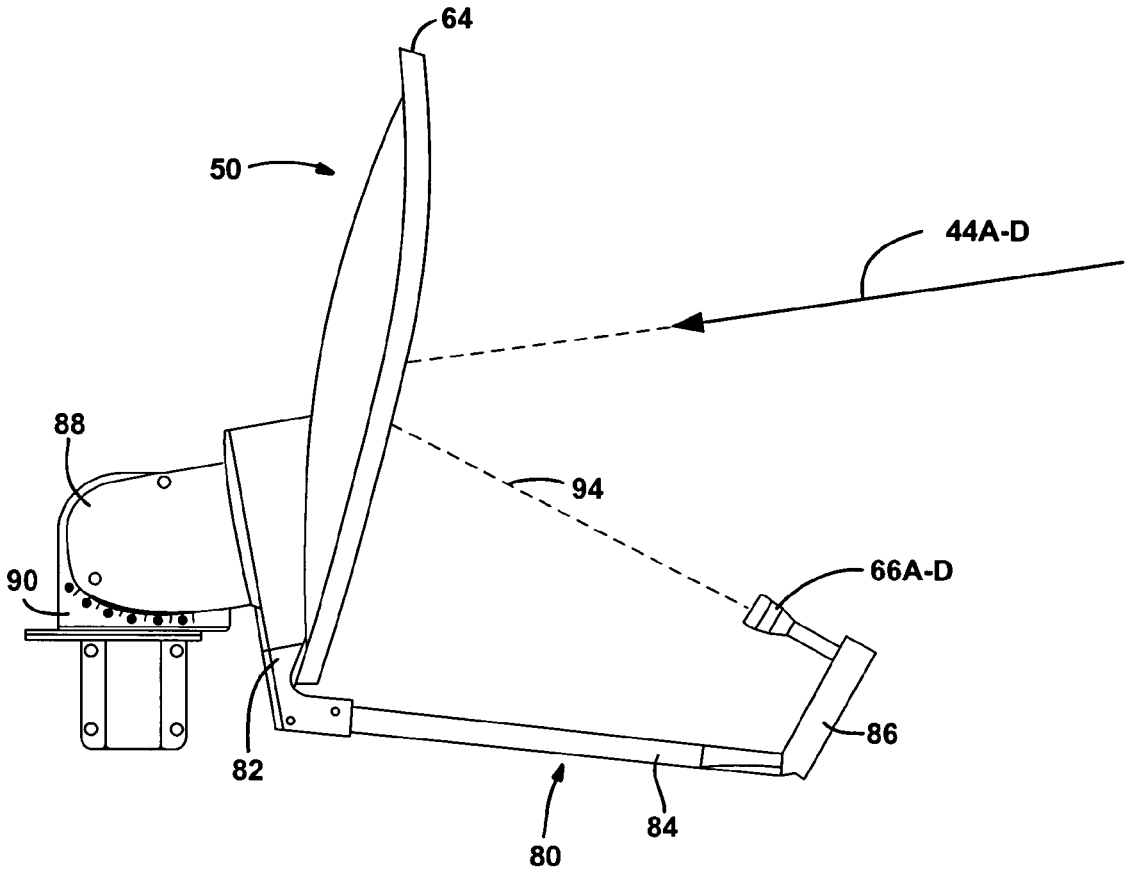
FIG. 3 is a side view of a first embodiment of an outdoor unit.

Referring now to FIG. 3, one embodiment of an outdoor unit 50 is illustrated. As mentioned above, the outdoor unit includes a primary reflector 64 and feeds 66A, 66B, 66C and 66D. The feeds 66A-D may be aligned in this view.

The reflector 64 and the feeds 66A-D are coupled to support structure 80. Support structure 80 may be configured in various ways to support the reflector and the feeds. In this embodiment, the support structure 80 includes a reflector support 82, an extension portion 84 and a feed support 86. The reflector support 82 may be coupled to an elevation adjustment mechanism 88 and an azimuth adjustment mechanism 90 to allow for pointing of the reflector 64 and locking the reflector 64 in a desired position or orientation.

As was mentioned above, the arrow 44A-D represents the downlink signals from the satellite 14. In this view, all signals are aligned. From a top view only signals 44B and C are aligned. Signals 44B, C originate from the same orbital spot and the same satellite or collocated satellites and share a primary axis 94. The primary axis 94 is aligned toward the feed 66B,C. Both signals 44B, C are aligned at feed 66B,C. When the signals 44B, C reflect from the reflector 64, both signals diverge slightly. This allows the concentric feeds to be used. This is illustrated in FIG. 4 below.

Figure 4:
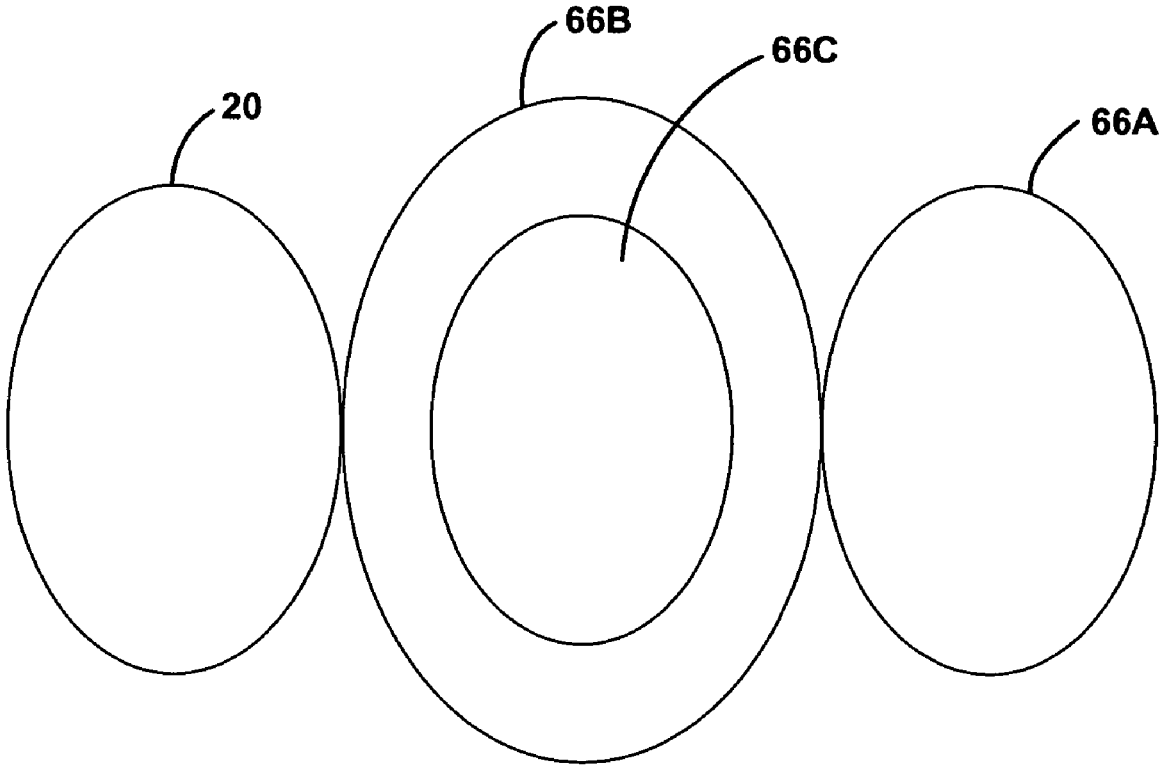
FIG. 4 is a front view of the feeds of FIG. 3.

Referring now to FIG. 4, feeds 66A-66D are illustrated in the direction of the primary axis 94. In this configuration, feeds 66A and 66D are directed to the outer orbital slots and may either be Ku or Ka band. Feed 66B is illustrated concentric with feed 66C. If feed 66C is Ka band, feed 66B is preferably another frequency other than Ka band such as Ku band. That is, the concentric feeds are preferably for two different frequencies. If the outer feed 66B is Ku band, it may be desirable to provide feeds 66A and 66D as Ka band. However, this is not a requirement but merely a way to reduce interference at the various feeds. The concentric feeds 66B and 66C may be integrally formed as one unit during manufacture. It should also be noted that feeds 66B and 66C may also provide a replacement for a feed having a particular frequency band. Thus, existing outdoor units may be retrofitted by providing a separate concentric feed. Because of the diverging signals reflected from the reflector 64, it is believed that enough spillover signal will reach the concentric feed 66B to allow a sufficient signal to be received.

While particular embodiments of the disclosure have been shown and described, numerous variations and alternate embodiments will occur to those skilled in the art. Accordingly, it is intended that the disclosure be limited only in terms of the appended claims.

What is claimed is:

1. A system comprising:

a first satellite at a first orbital slot having a first transponder generating a first downlink signal at a first frequency and a second downlink signal at a second frequency;

an outdoor unit directed at the first satellite comprising, a support structure;

a reflector coupled to the support structure and reflecting a first downlink signal from a first satellite, said first reflector reflecting a second downlink signal from the first satellite;

a first feed coupled to the support structure receiving the first downlink signal;

a second feed concentric with the first feed and coupled to the support structure receiving the second downlink signal.

2. A system as recited in claim 1 further comprising a second satellite at a second orbital slot having a third transponder generating a third downlink signal.

3. A system as recited in claim 2 wherein the outdoor unit comprises a third feed adjacent to the first and second feeds coupled to the support structure for receiving the third downlink signal.

4. system as recited in claim 2 wherein the first and third downlink signal comprises a Ka band signal.

5. A system as recited in claim 2 further comprising a third satellite at a third orbital slot having a fourth transponder generating a fourth downlink signal

6. A system as recited in claim 5 wherein the outdoor unit comprises a fourth feed coupled to the support structure adjacent to the first and second feeds for receiving the fourth downlink signal.

7. A system as recited in claim 5 wherein the fourth feed is adjacent to the first and second feeds.

8. A system as recited in claim 5 wherein the fourth feed is adjacent to the first feed opposite the third feed.

9. A system as recited in claim 5 wherein the fourth downlink signal comprises a Ka band signal.

10. A system as recited in claim 1 wherein the first downlink signal comprises a video signal.

11. A system as recited in claim 1 wherein the second downlink signal comprises a video signal.

12. A system as recited in claim 1 wherein the first downlink signal and the second downlink signal comprises a digital video signal.

13. A system as recited in claim 1 wherein the first downlink signal or second downlink signal comprises a high-definition digital video signal.

14. A system as recited in claim 1 wherein the second feed is separate from the first feed.

15. An outdoor unit comprising:

a support structure;

a reflector coupled to the support structure and reflecting a first downlink signal from a first satellite, said first reflector reflecting a second downlink signal from the first satellite;

a first feed coupled to the support structure receiving the first downlink signal;

a second feed concentric with the first feed and coupled to the support structure receiving the second downlink signal.

16. An outdoor unit as recited in claim 15 wherein the first downlink signal is reflected along an axis and the first feed and second feed are centered along the axis.

17. An outdoor unit as recited in claim 15 wherein the first downlink signal comprises a Ku band signal and the second downlink signal comprises a Ka band signal.

18. An outdoor unit as recited in claim 15 wherein the first reflector reflects a third downlink signal to a third feed adjacent to the first feed coupled to the support structure.

19. An outdoor unit as recited in claim 18 wherein the first and third downlink signal comprises a Ka band signal.

20. An outdoor unit as recited in claim 18 wherein the reflector reflects a fourth downlink signal.

21. An outdoor unit as recited in claim 20 wherein the outdoor unit comprises a fourth feed coupled to the support structure proximate to the first feed for receiving the fourth downlink signal.

22. An outdoor unit as recited in claim 21 wherein the fourth feed is adjacent to the first feed.

23. An outdoor unit as recited in claim 21 wherein the fourth feed is adjacent to the first feed opposite the third feed.

24. An outdoor unit as recited in claim 20 wherein the fourth downlink signal comprises a Ka band signal.

25. An outdoor unit as recited in claim 15 wherein the first downlink signal comprises a video signal.

26. An outdoor unit as recited in claim 15 wherein the second downlink signal comprises a video signal.

27. An outdoor unit as recited in claim 15 wherein the first downlink signal and the second downlink signal comprises a digital video signal.

28. An outdoor unit as recited in claim 15 wherein the first downlink signal or second downlink signal comprises a high-definition digital video signal.

29. An outdoor unit as recited in claim 15 wherein the first downlink signal comprises a digital video signal and the second downlink signal comprises a high-definition digital video signal.

30. An outdoor unit as recited in claim 15 wherein the second feed is separate from the first feed.

* * * * *